US011964182B2

(12) United States Patent
Brewer et al.

(10) Patent No.: US 11,964,182 B2
(45) Date of Patent: Apr. 23, 2024

(54) INDOOR BIKE STAND WITH SIDE MOVEMENT DEGREES

(71) Applicant: Aruanã Energia S.A., Goiânia (BR)

(72) Inventors: Brian Ray Brewer, Florianópolis (BR); Robert James McKinnon, Florianópolis (BR)

(73) Assignee: Aruanã Energia S.A., Goiânia (BR)

( * ) Notice: Subject to any disclaimer, the term of this patent is extended or adjusted under 35 U.S.C. 154(b) by 70 days.

(21) Appl. No.: 17/174,959

(22) Filed: Feb. 12, 2021

(65) Prior Publication Data

US 2021/0252335 A1 Aug. 19, 2021

(30) Foreign Application Priority Data

Feb. 17, 2020 (BR) ..... 102020003322-0

(51) Int. Cl.
*A63B 22/06* (2006.01)
*A63B 69/16* (2006.01)

(52) U.S. Cl.
CPC ..... *A63B 22/0605* (2013.01); *A63B 69/16* (2013.01); *A63B 2022/0641* (2013.01); *A63B 2069/162* (2013.01)

(58) Field of Classification Search
CPC ..... A63B 2069/161–168
See application file for complete search history.

(56) References Cited

U.S. PATENT DOCUMENTS 3,107,915 A * 10/1963 Looney ..... A63B 69/16 482/61
3,905,597 A * 9/1975 Tabb ..... A63B 69/16 482/61
4,026,546 A * 5/1977 Omori ..... A63B 69/16 482/61
6,126,577 A * 10/2000 Chang ..... A63B 26/003 434/61
7,520,842 B2 4/2009 Comair
7,736,282 B1 * 6/2010 Horowitz ..... A63B 69/16 482/61
7,883,449 B2 * 2/2011 Wan ..... A63B 69/16 482/57
7,963,889 B2 * 6/2011 Badarneh ..... A63B 26/003 482/57

(Continued)

FOREIGN PATENT DOCUMENTS

CA 2924958 A1 * 4/2015 ..... A61B 5/024
DE 2900483 A1 * 7/1980 ..... A63B 69/16

(Continued)

*Primary Examiner* — Nyca T Nguyen
(74) *Attorney, Agent, or Firm* — Day Pitney LLP; Anthony A. Kassas

(57) ABSTRACT

The present invention relates to an indoor stand with degrees of movement side gear for use with bicycles comprising two main components assembled in an integrated manner: 1) a rear roller and 2) a front stand that attaches to the fork, instead of the front wheel, in which springs or cushions below the front fork allow degree of lateral movement to the left and right, in which a main bar is coupled to the base by an axis that allows the lateral movement degrees with stability. The presence of these components makes the present invention well simulate the experience of pedaling outdoors and working on the user's shoulders, arms and abdomen.

9 Claims, 4 Drawing Sheets

(56) References Cited

U.S. PATENT DOCUMENTS 8,430,797 B2 * 4/2013 Wan ..... A63B 69/16 482/61
9,987,514 B1 * 6/2018 Tung ..... A63B 22/16
11,033,775 B2 * 6/2021 Chen ..... A63B 21/023
2004/0053751 A1 * 3/2004 Pizolato ..... A63B 26/003 482/61
2005/0209064 A1 * 9/2005 Peterson ..... A63B 69/16 482/61
2005/0245365 A1 * 11/2005 Rolli ..... A63B 22/0056 482/92
2012/0071301 A1 * 3/2012 Kaylor ..... A63B 22/0605 482/57
2013/0065734 A1 * 3/2013 Meyers ..... A63B 21/008 482/61
2015/0011364 A1 * 1/2015 Kimura ..... A63B 21/026 482/57
2015/0217158 A1 * 8/2015 Colan ..... A63B 21/0051 482/61
2015/0238808 A1 * 8/2015 Lin ..... A63B 22/0023 482/57
2016/0158620 A1 6/2016 Bauer et al.
2018/0200599 A1 7/2018 Lugton
2018/0339211 A1 * 11/2018 Coberly ..... A63B 69/16
2018/0369675 A1 * 12/2018 Papadopoulos ..... A63B 69/16
2019/0134480 A1 * 5/2019 Liao ..... A63B 21/225
2021/0252335 A1 * 8/2021 Brewer ..... A63B 21/023

FOREIGN PATENT DOCUMENTS

EP 3147187 A1 3/2017
GB 1476350 A * 6/1977 ..... A63B 69/16
TW 308498 B 4/2009
WO WO-2007083341 A1 * 7/2007 ..... A63B 69/16
WO WO-2012146230 A1 * 11/2012 ..... A63B 22/001

* cited by examiner

INDOOR BIKE STAND WITH SIDE MOVEMENT DEGREES

CROSS-REFERENCE TO RELATED APPLICATIONS

The present application claims the benefit and priority of Brazilian Patent Application No. 102020003322-0, filed on Feb. 17, 2020, the contents of which is incorporated herein by reference in its entirety for any purpose whatsoever.

FIELD OF THE DISCLOSURE

The present application relates to equipment that can be attached to a bicycle and, more particularly, to a bicycle stand that can simulate real conditions, with lateral movement degrees, for training exercises.

BACKGROUND OF THE DISCLOSURE

There are several bicycle stands that are known in the prior art, including documents US2018200599, EP3147187, U.S. Pat. No. 7,520,842, US2016158620 and TWI308498.

The exercise device described in document US2018200599 refers to a bicycle stand that comprises an inclined belt pivoted to contact the rear wheel of a bicycle, so that the belt moves in response to the rotation of the wheel and apply a predetermined voltage.

The exercise device described in EP3147187 discloses equipment comprising a pair of front wheel rollers to support a front bicycle wheel, a pair of rear wheel rollers to support a rear bicycle wheel and a belt for transmitting a rotation from the rear wheel roll to the front wheel rollers. The front wheel rollers support the front wheel of the bicycle. The equipment also includes front wheel roller adjusters and rear wheel roller adjusters. The front adjusters act so that the contact positions where the bicycle's front wheel comes into contact with the front wheel rollers become constant. The rear adjusters act according to the driving force of the bicycle.

The exercise device described in U.S. Pat. No. 7,520,842 discloses equipment that supports a bicycle while a cyclist is cycling. The equipment includes a stationary structure adapted to rest on a support surface and a rotating structure set. The rotating structure assembly is coupled to the stationary structure, the rotating structure assembly is adapted to be coupled to the bicycle and rotating with respect to the stationary structure to allow a bicycle structure to rotate through a predetermined angular displacement with respect to the stationary frame.

The exercise device described in the document US2016158620 reveals equipment that allows a person to use their own bicycle and simulates varied road conditions. The device includes front forks of a bicycle mounted on a support; wherein the support includes a flexible support arm, allowing the bicycle to swing back and forth along an oscillating arc; wherein the bicycle's rear fire faces a roller, so that the roller is free to rotate proportionally to the rotation of the rear tire. In addition, the roller is rotatably connected to a motor to selectively apply resistance and assist in rotating the rear fire to simulate real travel conditions. Preferably, the equipment also includes a motor assembly that includes a structure to house the roller and the motor and rigidly connect the motor assembly to the support, the motor is pivotally mounted on the structure around its axis, so that the motor and the roller rotate in unison proportional to each other.

The exercise device described in document TWI308498 reveals equipment adjustable to a bicycle for use indoors. The equipment includes a training platform with a roller bearing support for placing bicycles, a mechanism to allow the bearing support to move back and forth from left to right and a shock absorber that provides resistance to the wheel rear of the bike. A computer system coupled to the training platform controls the set back and forth, movements from left to right, and damper with interaction software simulating real exercise situations. Therefore, the bicycle can produce uphill, downhill and curved modes even when attached to the equipment.

However, the prior art documents neither reveal nor suggest an indoor stand with lateral movement degrees for use with bicycles that comprises two main components provided in an integrated manner: 1) a rear roller and 2) a front support which attaches to the fork, in place of the front wheel, in which springs or cushions below the front fork enable a degree of lateral movement to the left and right, as the equipment of the present disclosure. The presence of these components makes the present disclosure simulate the experience of pedaling outdoors and working on the user's shoulders, arms and abdomen.

SUMMARY OF THE DISCLOSURE

The present disclosure relates to a bicycle stand having a bicycle attached thereon. The bicycle stand includes a main bar comprising a first end and a second end and a front support fixedly attached to the first end of the main bar. The front support connects to a connecting arm and stabilizers, the connecting arm having a front fork of the bicycle mounted thereon. A second end of the main bar has an equally spaced toothed support configured to removably hold a roller set transverse to the main bar. The connecting arm and stabilizers are configured to allow movement in a lateral direction. A rear tire of the bicycle is in contact with the roller set, and the roller set is configured to allow unrestricted movement of the rear tire of the bicycle in a lateral direction.

In another embodiment, the front fork of the bicycle may be attached to the connecting arm by a fork screw element. The stabilizers may include a spring or a cushion.

BRIEF DESCRIPTION OF THE DRAWINGS

The disclosure will now be described by way of example with reference to the following drawings.

DETAILED DESCRIPTION

Figure 1:
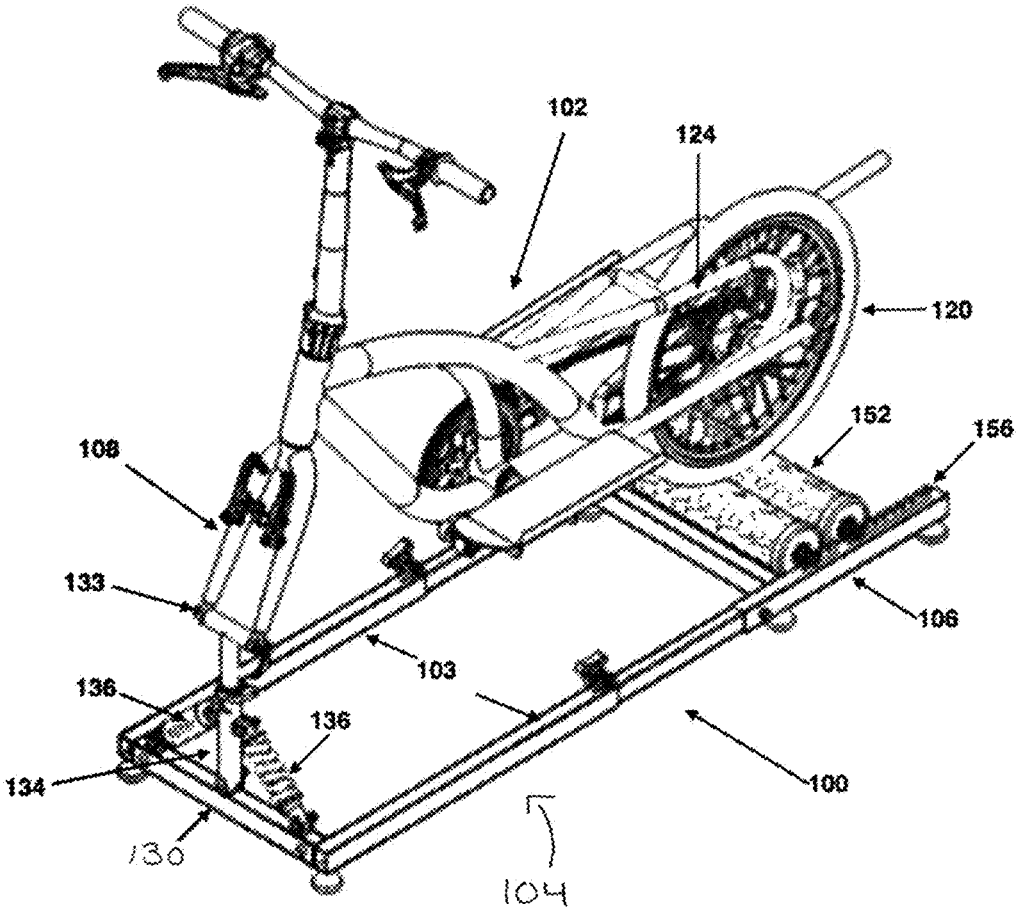
FIG. 1 is a schematic perspective view of the indoor bicycle stand assembly according to the present disclosure.
Figure 2:
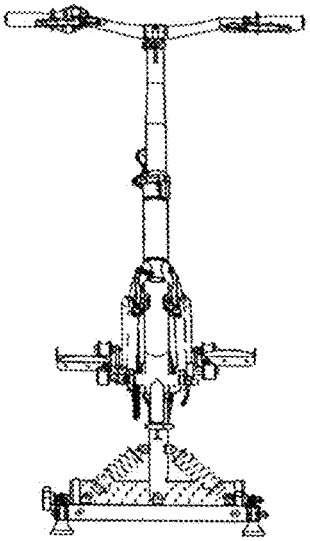
FIG. 2 is a schematic partial front view of the stand assembly, showing a degree of movement of the bicycle to the left (FIG. 2A) and to the right (FIG. 2B).
Figure 2A:
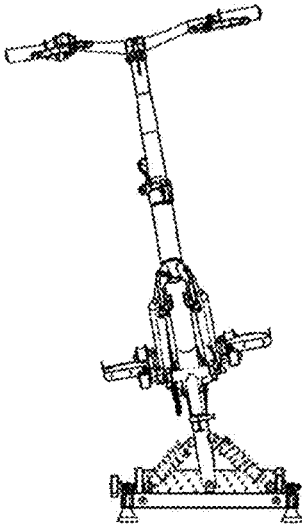
Figure 2B:
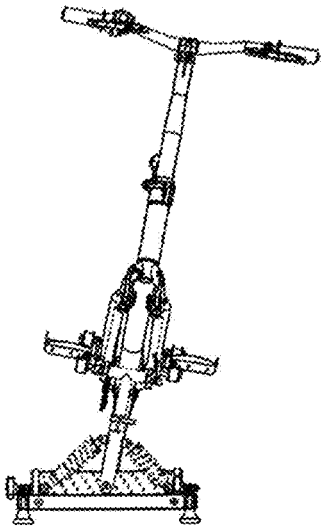
Figure 3:
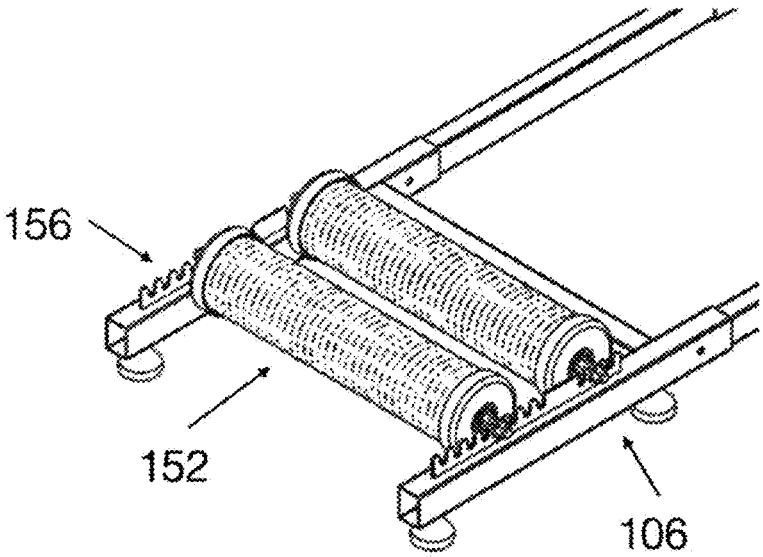
FIG. 3 is a schematic perspective view of the indoor bicycle stand assembly according to the present disclosure with emphasis on the rear rollers.

The equipment (100) shown schematically in FIG. 1 includes a bicycle (102), a bicycle stand (104) and a roller set (106) having two rollers (152). The bicycle stand (104) and roller set (106) engage a main bar (103), the main bar (103) extending between a front support (130) and a toothed support (156). The toothed support (156) guides the roller set (106) for rotation therein.

The bicycle (102) includes all the normal components of a bicycle, except the front wheel is removed from a front fork (108) thereof. The bicycle (102) therefore has, among other components, a steering wheel attached to a bicycle frame, a seat, pedals, a rear wheel (120) having a rear tire, and a chain (124).

The bicycle stand (104) includes a connecting arm (134) fixed on a pivot to and extending from the front support (130). The front support (130) is also connected to the connecting arm (134) via stabilizers (136) in the form of springs or cushions.

Figure 4:
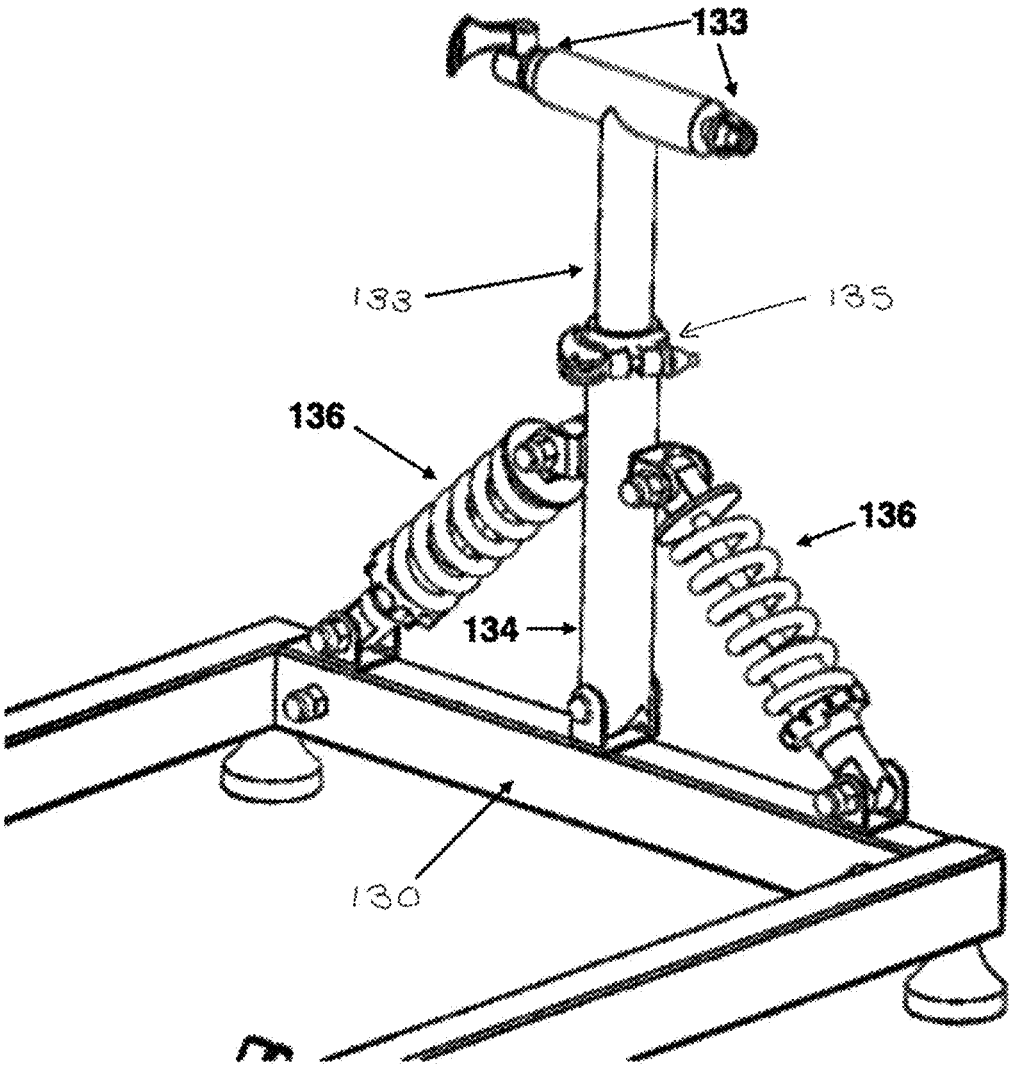
FIG. 4 is a schematic perspective view of the assembly for fitting the front fork of a bicycle, with emphasis on the support with lock comprising springs or cushions.
Figure 5:
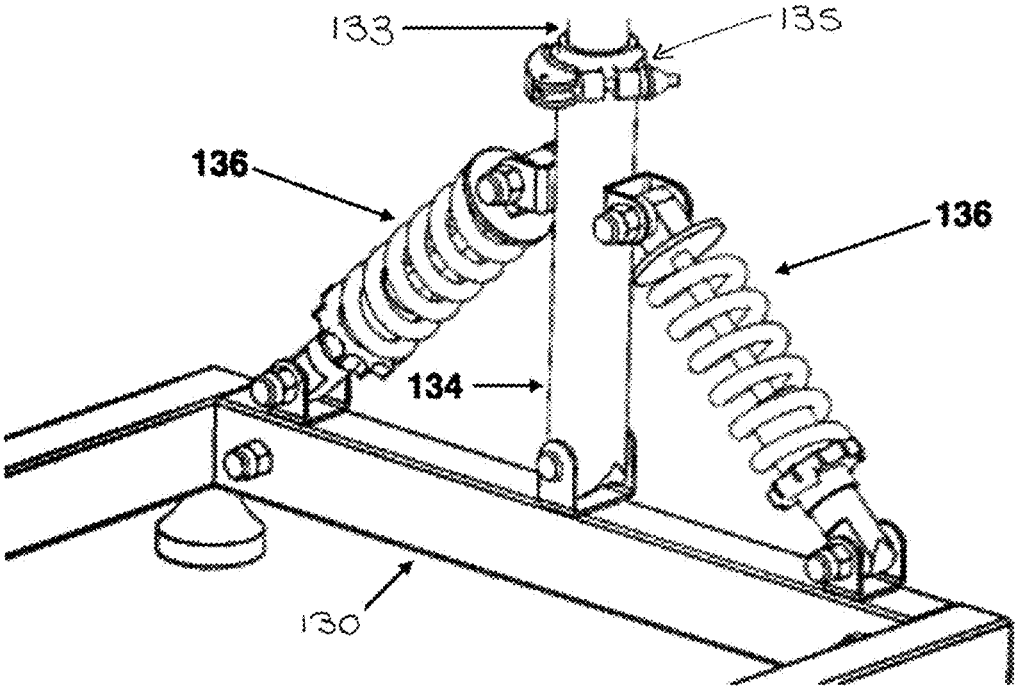
FIG. 5 is a schematic rear view of the assembly for fitting the front fork of a bicycle, with emphasis on the springs or cushions.

The connecting arm (134) is receives a fork screw element (133) on which the front fork (108) of the bicycle (102) mounts. The fork screw element (133) is configured to telescope into and out of the connecting arm (134) as evident in FIGS. 1 and 4. Though, the fork screw element (133) can be held in place relative to the connecting arm (134), and thus halt telescoping motion, via clamp (135).

The roller set (106) includes two rollers (152), as mentioned prior, that are connected sequentially and spaced along the toothed support (156). The two rollers (152) are configured for rotation along parallel axes. The rear tire (122) contacts the face of the rollers (156) for rotation.

In use, the user of the equipment (100) is able to use the bicycle (102) in conditions that simulate real life. Because the connecting arm (134) is coupled to the front support (130) on a pivot and supported by stabilizers (136), the bicycle (102) can move in a lateral direction along a swing arch, transverse a major length of the main bar (103).

It should be noted that the rear tire, mounted on the rear wheel (120), is free to move laterally, or side to side, due to the fact that the only point of contact between the rear wheel (120) and the bicycle stand (104) is on the face of the rollers (152). Therefore, as the user rides a bicycle (102), the user is free to move laterally, the degree of freedom of movement depending on the pivot connection between the connecting arm (134) and the front support (130), and the stabilizers (136).

It will be apparent to those skilled in the art that various modifications and adaptations of this structure described above are possible without departing from the spirit of the disclosure, the scope of which is defined in the attached claim.

The invention claimed is:

1. A bicycle stand having a bicycle attached thereon, comprising:

a main bar comprising a first end and a second end, the second end of the main bar having an equally spaced toothed support;

a front support fixedly attached to the first end of the main bar;

a connecting arm pivotably connected to the front support, the connecting arm also connected to the front support via stabilizers including a spring or cushion, the connecting arm having a front fork of the bicycle mounted thereon via a fork screw element, the fork screw element configured to telescope into and out of the connecting arm; and a roller set configured to be removably held transverse to the main bar on the toothed support, wherein the connecting arm and stabilizers are configured to move side to side along a swing arch in a direction perpendicular to a major axis of the main bar, allowing lateral movement of the bicycle, and wherein a rear tire of the bicycle is in contact with the roller set, the roller set is configured to allow unrestricted movement of the rear tire of the bicycle in a lateral direction.

2. The frame of claim 1, wherein the roller set comprises two rollers situated parallel to each other.

3. The frame of claim 1, wherein the bicycle is configured to pivot with a degree of freedom correlating to the flexibility of the connecting arm or the strength of the stabilizers.

4. The frame of claim 1, wherein the fork screw element is perpendicular to the connecting arm and configured to attach to the front fork of the bicycle.

5. A frame for mounting a bicycle thereon, the frame comprising:

two elongate main bars situated parallel to each other and extending from a first end to a second end respectively, the second end of the main bars having equally spaced toothed supports;

a front support perpendicular to the two elongate main bars and connecting the first ends of the two elongate main bars;

a connecting arm pivotably coupled to the front support, the connecting arm supported by stabilizers extending between the connecting arm and the front support;

a fork screw element supported by the connecting arm and configured to telescope into and out of the connecting arm, the fork screw element configured to receive and mount a front fork of the bicycle thereon; and a roller set configured to be removably held transverse to the main bar on the equally spaced toothed supports, a rear tire of the bicycle configured to contact the roller set, wherein the connecting arm is configured to move side to side along a swing arch and a major axis of the front support.

6. The frame of claim 5, wherein the roller set comprises two rollers situated parallel to each other.

7. The frame of claim 5, wherein the bicycle is configured to pivot with a degree of freedom correlating to the flexibility of the connecting arm or the strength of the stabilizers.

8. A bicycle stand for stationary use of a bicycle, the bicycle stand comprising:

two main bars extending parallel to each other, the main bars each defining toothed slots at a first end thereof;

a front support positioned perpendicular to and connecting the main bars at a second end thereof, the front support in the same plane as the main bars;

a connecting arm pivotably connected and extending vertically from the front support, the connecting arm configured to swing along an axis of the front support;

a stabilizer connected to the connecting arm and the front support to resist the connecting arm from swinging along the axis of the front support;

a fork screw element extending from the connecting arm, the fork screw element defining a T-shape in order to receive a front fork of the bicycle; and two parallel rollers situated in the toothed slots of the main bars, a rear tire of the bicycle configured to contact the two rollers and rotate therewith.

9. The frame of claim 8, wherein the bicycle is configured to swing along the axis of the front support with a degree of freedom correlating to a flexibility of the connecting arm or a strength of the stabilizers.

* * * * *